US008499605B2

(12) United States Patent
Bryan

(10) Patent No.: US 8,499,605 B2
(45) Date of Patent: Aug. 6, 2013

(54) HOT STRETCH STRAIGHTENING OF HIGH STRENGTH α/β PROCESSED TITANIUM

(75) Inventor: David J. Bryan, Indian Trail, NC (US)

(73) Assignee: ATI Properties, Inc., Albany, OK (US)

( * ) Notice: Subject to any disclaimer, the term of this patent is extended or adjusted under 35 U.S.C. 154(b) by 373 days.

(21) Appl. No.: 12/845,122

(22) Filed: Jul. 28, 2010

(65) Prior Publication Data

US 2012/0024033 A1 Feb. 2, 2012

(51) Int. Cl.
*C22F 1/18* (2006.01)
*B21D 3/12* (2006.01)

(52) U.S. Cl.
USPC ..... 72/342.1; 72/342.2; 72/342.5; 72/364; 72/367.1; 148/568; 148/645; 148/646; 148/670

(58) Field of Classification Search
USPC 72/342.1, 342.2, 342.5, 364, 367.1; 148/568, 148/645, 646, 670
See application file for complete search history.

(56) References Cited

U.S. PATENT DOCUMENTS

| | | | |
|---|---|---|---|
| 2,857,269 | A | 10/1958 | Vordahl |
| 2,932,886 | A | 4/1960 | Althouse |
| 3,313,138 | A | 4/1967 | Spring et al. |
| 3,379,522 | A | 4/1968 | Vordahl |
| 3,489,617 | A | 1/1970 | Wuerfel |
| 3,615,378 | A | 10/1971 | Bomberger et al. |
| 3,635,068 | A | 1/1972 | Watmough et al. |
| 3,686,041 | A | 8/1972 | Lee |
| 3,979,815 | A | 9/1976 | Nakanose et al. |
| 4,053,330 | A | 10/1977 | Henricks et al. |
| 4,067,734 | A | 1/1978 | Curtis et al. |
| 4,094,708 | A | 6/1978 | Hubbard et al. |
| 4,098,623 | A | 7/1978 | Ibaraki et al. |
| 4,147,639 | A | 4/1979 | Lee et al. |
| 4,197,643 | A | 4/1980 | Burstone et al. |

(Continued)

FOREIGN PATENT DOCUMENTS

| | | | |
|---|---|---|---|
| CN | 1070230 | A | 3/1993 |
| CN | 101637789 | B | 6/2011 |

(Continued)

OTHER PUBLICATIONS

Office Action mailed Oct. 19, 2011 in U.S. Appl. No. 12/691,952.

(Continued)

*Primary Examiner* — Dana Ross
*Assistant Examiner* — Onekki Jolly
(74) *Attorney, Agent, or Firm* — K & L Gates LLP; Patrick J. Viccaro; John E. Grosselin, III

(57) ABSTRACT

A method for straightening a solution treated and aged (STA) titanium alloy form includes heating an STA titanium alloy form to a straightening temperature of at least 25° F. below the age hardening temperature, and applying an elongation tensile stress for a time sufficient to elongate and straighten the form. The elongation tensile stress is at least 20% of the yield stress and not equal to or greater than the yield stress at the straightening temperature. The straightened form deviates from straight by no greater than 0.125 inch over any 5 foot length or shorter length. The straightened form is cooled while simultaneously applying a cooling tensile stress that balances the thermal cooling stress in the titanium alloy form to thereby maintain a deviation from straight of no greater than 0.125 inch over any 5 foot length or shorter length.

16 Claims, 9 Drawing Sheets

U.S. PATENT DOCUMENTS 4,229,216 A 10/1980 Paton et al.
4,309,226 A 1/1982 Chen
4,482,398 A 11/1984 Eylon et al.
4,543,132 A 9/1985 Berczik et al.
4,631,092 A 12/1986 Ruckle et al.
4,639,281 A 1/1987 Sastry et al.
4,668,290 A 5/1987 Wang et al.
4,687,290 A 8/1987 Prussas
4,688,290 A 8/1987 Hogg
4,690,716 A 9/1987 Sabol et al.
4,714,468 A 12/1987 Wang et al.
4,799,975 A 1/1989 Ouchi et al.
4,808,249 A 2/1989 Eylon et al.
4,842,653 A 6/1989 Wirth et al.
4,851,055 A 7/1989 Eylon et al.
4,854,977 A 8/1989 Alheritiere et al.
4,857,269 A 8/1989 Wang et al.
4,878,966 A 11/1989 Alheritiere et al.
4,889,170 A 12/1989 Mae et al.
4,943,412 A 7/1990 Bania et al.
4,975,125 A 12/1990 Chakrabarti et al.
4,980,127 A 12/1990 Parris et al.
5,026,520 A 6/1991 Bhowal et al.
5,032,189 A 7/1991 Eylon et al.
5,041,262 A 8/1991 Gigliotti, Jr.
5,074,907 A 12/1991 Amato et al.
5,080,727 A 1/1992 Aihara et al.
5,141,566 A 8/1992 Kitayama et al.
5,156,807 A 10/1992 Nagata et al.
5,162,159 A 11/1992 Tenhover et al.
5,169,597 A 12/1992 Davidson et al.
5,173,134 A 12/1992 Chakrabarti et al.
5,201,457 A 4/1993 Kitayama et al.
5,244,517 A 9/1993 Kimura et al.
5,264,055 A 11/1993 Champin et al.
5,277,718 A 1/1994 Paxson et al.
5,332,454 A 7/1994 Meredith et al.
5,332,545 A 7/1994 Love
5,342,458 A 8/1994 Adams et al.
5,358,586 A 10/1994 Schutz
5,442,847 A 8/1995 Semiatin et al.
5,472,526 A 12/1995 Gigliotti, Jr.
5,509,979 A 4/1996 Kimura
5,516,375 A 5/1996 Ogawa et al.
5,520,879 A 5/1996 Saito et al.
5,545,262 A * 8/1996 Hardee et al. ..... 148/527
5,545,268 A 8/1996 Yashiki et al.
5,558,728 A 9/1996 Kobayashi et al.
5,580,665 A 12/1996 Taguchi et al.
5,658,403 A * 8/1997 Kimura ..... 148/671
5,662,745 A * 9/1997 Takayama et al. ..... 148/237
5,679,183 A 10/1997 Takagi et al.
5,698,050 A 12/1997 El-Soudani
5,758,420 A 6/1998 Schmidt et al.
5,759,484 A 6/1998 Kashii et al.
5,795,413 A 8/1998 Gorman
5,871,595 A 2/1999 Ahmed et al.
5,897,830 A 4/1999 Abkowitz et al.
5,954,724 A * 9/1999 Davidson ..... 606/76
5,980,655 A 11/1999 Kosaka
6,053,993 A 4/2000 Reichman et al.
6,071,360 A 6/2000 Gillespie
6,077,369 A * 6/2000 Kusano et al. ..... 148/568
6,127,044 A 10/2000 Yamamoto et al.
6,132,526 A 10/2000 Carisey et al.
6,139,659 A 10/2000 Takahashi et al.
6,143,241 A * 11/2000 Hajaligol et al. ..... 419/31
6,187,045 B1 * 2/2001 Fehring et al. ..... 623/11.11
6,200,685 B1 3/2001 Davidson
6,228,189 B1 5/2001 Oyama et al.
6,250,812 B1 6/2001 Ueda et al.
6,258,182 B1 7/2001 Schetky et al.
6,284,071 B1 9/2001 Suzuki et al.
6,332,935 B1 12/2001 Gorman et al.
6,384,388 B1 5/2002 Anderson et al.
6,387,197 B1 5/2002 Bewlay et al.
6,391,128 B2 * 5/2002 Ueda et al. ..... 148/669
6,402,859 B1 * 6/2002 Ishii et al. ..... 148/421
6,409,852 B1 6/2002 Lin et al.
6,536,110 B2 3/2003 Smith et al.
6,539,607 B1 4/2003 Fehring et al.
6,539,765 B2 * 4/2003 Gates ..... 72/69
6,558,273 B2 5/2003 Kobayashi et al.
6,632,304 B2 10/2003 Oyama et al.
6,663,501 B2 * 12/2003 Chen ..... 473/324
6,726,784 B2 4/2004 Oyama et al.
6,742,239 B2 * 6/2004 Lee et al. ..... 29/596
6,773,520 B1 8/2004 Fehring et al.
6,786,985 B2 9/2004 Kosaka et al.
6,800,153 B2 * 10/2004 Ishii et al. ..... 148/671
6,918,971 B2 * 7/2005 Fujii et al. ..... 148/421
7,032,426 B2 * 4/2006 Durney et al. ..... 72/324
7,038,426 B2 * 5/2006 Hall ..... 320/135
7,132,021 B2 * 11/2006 Kuroda et al. ..... 148/671
7,152,449 B2 * 12/2006 Durney et al. ..... 72/324
7,264,682 B2 * 9/2007 Chandran et al. ..... 148/210
7,269,986 B2 9/2007 Pfaffmann et al.
7,332,043 B2 2/2008 Tetyukhin et al.
7,410,610 B2 * 8/2008 Woodfield et al. ..... 419/34
7,438,849 B2 * 10/2008 Kuramoto et al. ..... 420/417
7,449,075 B2 * 11/2008 Woodfield et al. ..... 148/671
7,611,592 B2 11/2009 Davis et al.
7,837,812 B2 11/2010 Marquardt et al.
7,879,286 B2 2/2011 Miracle et al.
2003/0168138 A1 * 9/2003 Marquardt ..... 148/671
2004/0099350 A1 * 5/2004 Mantione et al. ..... 148/538
2004/0221929 A1 11/2004 Hebda et al.
2004/0250932 A1 * 12/2004 Briggs ..... 148/670
2007/0017273 A1 1/2007 Haug et al.
2007/0193662 A1 * 8/2007 Jablokov et al. ..... 148/421
2007/0286761 A1 * 12/2007 Miracle et al. ..... 419/12
2008/0210345 A1 9/2008 Tetyukhin et al.
2008/0264932 A1 10/2008 Hirota
2009/0183804 A1 7/2009 Zhao et al.
2010/0307647 A1 12/2010 Marquardt et al.
2011/0038751 A1 2/2011 Marquardt et al.
2012/0076611 A1 3/2012 Bryan
2012/0076612 A1 3/2012 Bryan
2012/0076686 A1 3/2012 Bryan

FOREIGN PATENT DOCUMENTS

DE 10128199 A1 12/2002
DE 102010009185 A1 11/2011
EP 0535817 B1 4/1995
EP 0611831 B1 1/1997
EP 0707085 B1 1/1999
EP 0683242 B1 5/1999
EP 1083243 A2 3/2001
EP 1302554 A1 4/2003
EP 1302555 A1 4/2003
EP 1612289 A2 1/2006
EP 1882752 A2 1/2008
EP 2028435 A1 2/2009
GB 847103 9/1960
GB 1433306 4/1976
GB 2337762 A 12/1999
JP 55-113865 A 9/1980
JP 57-62846 A 4/1982
JP 60-046358 * 3/1985
JP 62-109956 A 5/1987
JP 62109956 * 5/1987
JP 1-279736 A 11/1989
JP 2-205661 A 8/1990
JP 3-134124 A 6/1991
JP 4-74856 A 3/1992
JP 19920330 * 3/1992
JP 5-117791 A 5/1993
JP 5-195175 A 8/1993
JP 8-300044 A 11/1996
JP 9-194969 A 7/1997
JP 9-215786 A 8/1997
JP 11-343528 A 12/1999
JP 11-343548 A 12/1999
JP 2000-153372 A 6/2000
JP 2003-55749 A 2/2003
JP 2003-74566 A 3/2003
KR 10-2005-0087765 A 8/2005

| | | | | |
|---|---|---|---|---|
| RU | 2197555 | C1 | | 7/2001 |
| RU | 2172359 | C1 | | 8/2001 |
| SU | 534518 | A1 | | 1/1977 |
| SU | 1088397 | | * | 2/1991 |
| SU | 1088397 | A1 | | 2/1991 |
| WO | WO 98/22629 | A | | 5/1998 |
| WO | WO 02/090607 | | | 11/2002 |
| WO | WO 2004/101838 | A1 | | 11/2004 |
| WO | WO 2008/017257 | A1 | | 2/2008 |

OTHER PUBLICATIONS

Notice of Allowance mailed Jun. 27, 2011 in U.S. Appl. No. 11/745,189.
Office Action mailed Jul. 27, 2011 in U.S. Appl. No. 12/857,789.
Advisory Action mailed Oct. 7, 2011 in U.S. Appl. No. 12/857,789.
U.S. Appl. No. 13/250,046, filed Sep. 12, 2011.
U.S. Appl. No. 13/230,143, filed Sep. 12, 2011.
Naik, Uma M. et al., "Omega and Alpha Precipitation in Ti-15Mo Alloy, "Titanium '80 Science and Technology—Proceedings of the 4th International Conference on Titanium, H. Kimura & O. Izumi Eds. May 19-22, 1980 pp. 1335-1343.
Pennock, G.M. et al., "The Control of a Precipitation by Two Step Ageing in β Ti-15Mo," Titanium '80 Science and Technology—Proceedings of the 4th International Conference on Titanium, H. Kimura & O. Izumi Eds. May 19-22, 1980 pp. 1344-1350.
Bowen, A. W., "On the Strengthening of a Metastable b-Titanium Alloy by w- and a-Precipitation" Royal Aircraft Establishment Technical Memorandum Mat 338, (1980) pp. 1-15 and Figs 1.5.
Bowen, A. W., "Omega Phase Embrittlement in Aged Ti-15%Mo," Scripta Metaflurgica, vol. 5, No. 8 (1971) pp. 709-715.
"ASTM Designation F2066-01 Standard Specification for Wrought Titanium-15 Molybdenum Alloy for Surgical Implant Applications (UNS R58150)," ASTM International (2000) pp. 1-4.
Disegi, J. A., "Titanium Alloys for Fracture Fixation Implants," Injury International Journal of the Care of the Injured, vol. 31 (2000) pp. S-D14-17.
Ho, W.F. et al., "Structure and Properties of Cast Binary Ti-Mo Alloys" Biomaterials. vol. 20 (1999) pp. 2115-2122.
ASM Materials Engineering Dictionary, J.R. Davis Ed., ASM International, Materials Park, OH (1992) p. 39.
ALLVAC, Product Specification for "Allvac Ti-15 Mo," available at http://www.allvac.com/allvac/pages/Titanium/Ti15MO.htm, last visited Jun. 9, 2003 p. 1 of 1.
Lemons, Jack et al., "Metallic Biomaterials for Surgical Implant Devices," BONEZone, Fall (2002) p. 5-9 and Table.
"ASTM Designation F1801-97 Standard Practice for Corrosion Fatigue Testing of Metallic Implant Materials" ASTM International 1997 pp. 876-880.
Zardiackas, L.D. et al., "Stress Corrosion Cracking Resistance of Titanium Implant Materials," Transactions of the 27th Annual Meeting of the Society for Biomaterials. (2001).
Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.
Roach, M.D., et al., "Stress Corrosion Cracking of a Low-Nickel Stainless Steel," Transactions of the 27th Annual Meeting of the Society for Biomaterials, 2001, p. 469.
ATI Ti-15Mo Beta Titanium Alloy Technical Data Sheet, ATI Allvac, Monroe, NC, Mar. 21, 2008, 3 pages.
Lütjering, G. and J.C. Williams, Titanium, Springer, New York (2nd ed. 2007) p. 24.
Murray, J.L., The Mn-Ti (Manganese-Titanium) System, Bulletin of Alloy Phase Diagrams, vol. 2, No. 3 (1981) p. 334-343.
Semiatin, S.L. et al., "The Thermomechanical Processing of Alpha/Beta Titanium Alloys," Journal of Metals, Jun. 1997, pp. 33-39.
Weiss, I. et al., "Thermomechanical Processing of Beta Titanium Alloys—An Overview," Material Science and Engineering, A243, 1998, pp. 46-65.
Weiss, I. et al., "The Processing Window Concept of Beta Titanium Alloys". Recrystallization '90, ed. by T. Chandra, The Minerals, Metals & Materials Society, 1990, pp. 609-616.
Froes, F.H. et al., "The Processing Window for Grain Size Control in Metastable Beta Titanium Allows". Beta Titanium Alloys in the 80's, ed. by R. Boyer and H. Rosenberg, AIME, 1984, pp. 161-164.
Myers, J., "Primary Working, A lesson from Titanium and its Alloys," ASM Course Book 27 Lesson, Test 9, Aug. 1994, pp. 3-4.
Metals Handbook, Desk Edition, 2nd ed., J. R. Davis ed., ASM International, Materials Park, Ohio (1998), pp. 575-588.
Tamarisakandala, S. et al., "Strain-induced Porosity During Cogging of Extra-Low Interstitial Grade Ti-6AI-4V", Journal of Materials Engineering and Performance, vol. 10(2), Apr. 2001, pp. 125-130.
Prasad, Y.V.R.K. et al. "Hot Deformation Mechanism in Ti-6AI-4V with Transformed B Starting Microstructure: Commerical v. Extra Low Interstitial Grade", Materials Science and Technology, Sep. 2000, vol. 16, pp. 1029-1036.
Russo, P.A., "Influence of Ni and Fe on the Creep of Beta Annealed Ti-6242S", Titanium '95: Science and Technology, pp. 1075-1082.
Williams, J., Thermo-mechanical processing of high-performance Ti alloys: recent progress and future needs, Journal of Material Processing Technology, 117 (2001), p. 370-373.
Lutjering, G. and Williams, J.C., Titaniium, Springer-Verlag, 2003, Ch. 5: Alpha+Beta Alloys, p. 177-201.
Boyer, Rodney R., "Introduction and Overview of Titanium and Titanium Alloys: Applications," Metals Handbook, ASM Handbooks Online (2002).
Callister, Jr., William D., Materials Science and Engineering, An Introduction, Sixth Edition, John Wiley & Sons, pp. 180-184 (2003).
"Heat Treating of Nonferrous Alloys: Heat Treating of Titanium and Titanium Alloys," Metals Handbook, ASM Handbooks Online (2002).
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.
Fedotov, S.G. et al., "Effect of Aluminum and Oxygen on the Formation of Metastable Phases in Alloys of Titanium with .beta.-Stabilizing Elements", Izvestiya Akademil Nauk SSSR Metally (1974) pp. 121-126.
Long, M. et al., "Friction and Surface Behavior of Selected Titanium Alloys During Reciprocating-Sliding Motion", WEAR, 249 (1-2), 158-168.
Takemoto Y et al., "Tensile Behavior and Cold Workability of Ti-Mo Alloys", Materials Transactions Japan Inst. Metals Japan, vol. 45, No. 5, May 2004, pp. 1571-1576.
Lampman, S., "Wrought and Titanium Alloys," ASM Handbooks Online, ASM International, 2002.
Roach, M.D., et al., "Comparison of the Corrosion Fatigue Characteristics of CPTi-Grade 4, Ti-6A1-4V ELI, Ti-6A1-7 Nb, and Ti-15 Mo", Journal of Testing and Evaluation, vol. 2, Issue 7, (Jul./Aug. 2005) (published online Jun. 8, 2005).
Jablokov et al., "The Application of Ti-15 Mo Beta Titanium Alloy in High Strength Orthopaedic Applications", Journal of ASTM International, vol. 2, Issue 8 (Sep. 2005) (published online Jun. 22, 2005).
Marquardt et al., "Beta Titanium Alloy Processed for High Strength Orthopaedic Applications "Journal of ASTM International vol. 2, Issue 9 (Oct. 2005) (published online Aug. 17, 2005).
SAE Aerospace Material Specification 4897A (issued Jan. 1997. revised Jan. 2003).
"Datasheet: Timetal 21S", Alloy Digest, Advanced Materials and Processes (Sep. 1998), pp. 38-39.
"Stryker Orthopaedics TMZF® Alloy (UNS R58120)", printed from www.allvac.com/allvac/pages/Titanium/UNSR58120.htm on Nov. 7, 2005.
ASTM Designation F 2066-01, "Standard Specification for Wrought Titanium-15 Molybdenum Alloy for Surgical Implant Applications (UNS R58150)" 7 pages.
"Technical Data Sheet: Ailvac® Ti-15Mo Beta Titanium Alloy" (dated Jun. 16, 2004).

"Allvac TiOsteum and TiOstalloy Beat Titanium Alloys", printed from www.allvac.com/allvac/pages/Titanium/TiOsteum.htm on Nov. 7, 2005.
Donachie Jr., M.J., "Titanium A Technical Guide" 1988, ASM, pp. 39 and 46-50.
Standard Specification for Wrought Titanium—6Aluminum—4Vanadium Alloy for Surgical Implant Applications (UNS R56400), Desgination: F 1472-99, ASTM 1999, pp. 1-4.
Two new α-β titanium alloys, KS Ti-9 for sheet and KS EL-F for forging, with mechanical properties comparable to Ti-6AI-4V, Oct. 8, 2002, ITA 2002 Conference in Orlando, Hideto Oyama, Titanium Technology Dept., Kobe Steel, Ltd., 16 pages.
Harper, Megan Lynn, "A Study of the Microstructural and Phase Evolutions in Timetal 555", Jan. 2001, retrieved from http://www.ohiolink.edu/etd/send-pdf.cgi/harper%20megan%20lynn.pdf?acc_num=osu1132165471 on Aug. 10, 2009, 92 pages.
Nyakana, et al., "Quick Reference Guide for β Titanium Alloys in the 00s", Journal of Materials Engineering and Performance, vol. 14, No. 6; Dec. 1, 2005, pp. 790-811.
ATI 425®-MIL Alloy, Technical Data Sheet Version 2, Aug. 16, 2010, 5 pages.
U.S. Appl. No. 12/885,620, filed Sep. 20, 2010.
U.S. Appl. No. 12/838,674, filed Jul. 19, 2010.
Cain, Patrick, "Warm forming aluminum magnesium components; How it can optimize formability, reduce springback", Aug. 1, 2009, from http://www.thefabricator.com/article/presstechnology/warm-forming-aluminum-magnesium-components, 3 pages.
Tebbe, Patrick A. and Ghassan T. Kridli, "Warm forming aluminum alloys: an overview and future directions", Int. J. Materials and Product Technology, vol. 21, Nos. 1-3, 2004, pp. 24-40.
Duflou et al., "A method for force reduction in heavy duty bending", Int. J. Materials and Product Technology, vol. 32, No. 4, 2008, pp. 460-475.
Imatani et al., "Experiment and simulation for thick-plate bending by high frequency inductor", ACTA Metallurgica Sinica, vol. 11, No. 6, Dec. 1998, pp. 449-455.
Rudnev et at., "Longitudinal flux indication heating of slabs, bars and strips is no longer "Black Magic:" II", Industrial Heating, Feb. 1995, pp. 46-48 and 50-51.
Nguyen et al., "Analysis of bending deformation in triangle heating of steel plates with induction heating process using laminated plate theory", Mechanics Based Design of Structures and Machines, 37, 2009, pp. 228-246.
Lee et al., "An electromagnetic and thermo-mechanical analysis of high frequency induction heating for steel plate bending", Key Engineering Materials, vols. 326-328, 2006, pp. 1283-1286.
Kovtun, et al., "Method of calculating induction heating of steel sheets during thermomechanical bending", Kiev, Nikolaev, translated from Problemy Prochnosti, No. 5, pp. 105-110, May 1978, original article submitted Nov. 27, 1977, pp. 600-606.
ATI 425®-MIL Alloy, Technical Data Sheet, Version 1, May 28, 2010, pp. 1-5.
ATI 425® Alloy, Technical Data Sheet, Version 1, May 28, 2010, pp. 1-5.
ATI 500-MIL™, Mission Critical Metallics®, High Hard Specialty Steel Armor, Version 4, Sep. 10, 2009, pp. 1-4.
ATI 600-MIL®, Preliminary Draft Data Sheet, Ultra High Hard Specialty Steel Armor, Version 4, Aug. 10, 2010, pp. 1-3.
ATI 600-MIL™, Preliminary Draft Data Sheet, Ultra High Hard Specialty Steel Armor, Version 3, Sep. 10, 2009, pp. 1-3.
ATI Ti-I 5Mo Beta Titanium Alloy, Technical Data Sheet, Mar. 21, 2008, pp. 1-3.
ATI Titanium 6AI-2Sn-4Zr-2Mo Alloy, Technical Data Sheet, Version 1, Sep. 17, 2010, pp. 1-3.
ATI Aerospace Materials Development, Mission Critical Metallics, Apr. 30, 2008, 17 pages.
Shahan et al., "Adiabatic shear bands in titanium and titanium alloys: a critical review", Materials & Design, vol. 14, No. 4, 1993, pp. 243-250.
Zhang et al., "Simulation of slip band evolution in duplex Ti-6AI-4V", Acta Materialia, vol. 58, 2010, pp. 1087-1096.
ATI 425®-MIL Titanium Alloy, Mission Critical Metallics®, Version 3, Sep. 10, 2009, pp. 1-4.
ATI Wah Chang, Titanium and Titanium Alloys, Technical Data Sheet, 2003, pp. 1-16.
ATI Wah Chang, ATI™ 425 Titanium Alloy (Ti-4AI-2.5V-1.5Fe-0.250$_2$), Technical Data Sheet, 2004, pp. 1-5.
ATI Titanium 6AI-4V Alloy, Mission Critical Metallics®, Technical Data Sheet, Version 1, Apr. 22, 2010, pp. 1-3.
SAE Aerospace, Aerospace Material Specification, Titanium Alloy Bars, Forgings and Forging Stock, 6.0AI-4.0V, Solution Heat Treated and Aged, AMS 6930A, Issued Jan. 2004, Revised Feb. 2006, pp. 1-9.
SAE Aerospace, Aerospace Material Specification, Titanium Alloy Bars, Forgings and Forging Stock, 6.0AI-4.0V Annealed, AMS 6931A, Issued Jan. 2004, Revised Feb. 2007, pp. 1-7.
SAE Aerospace, Aerospace Material Specification, Titanium Alloy, Sheet, Strip, and Plate, 4AI-2.5V-1.5Fe, Annealed, AMS 6946A, Issued Oct. 2006, Revised Jun. 2007, pp. 1-7.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 29, 1997, superseding MIL-STD-13, Jul. 26, 1985, 10 pages.
Nishimura, T. "Ti-15Mo-5Zr-3Al", Materials Properties Handbook: Titanium Alloys, eds. R. Boyer et al., ASM International, Materials Park, OH, 1994, p. 949.
Greenfield, Dan L., News Release, ATI Aerospace Presents Results of Year-Long Characterization Program for New ATI 425 Alloy Titanium Products at Aeromat 2010, Jun. 21, 2010, Pittsburgh, Pennsylvania, 1 page.
McDevitt, et al., Characterization of the Mechanical Properties of ATI 425 Alloy According to the Guidelines of the Metallic Materials Properties Development & Standardization Handbook, Aeromat 2010 Conference and Exposition: Jun. 20-24, 2010, Bellevue, WA, 23 pages.
Technical Presentation: Overview of MMPDS Characterization of ATI 425 Alloy, 2012, 1 page.
ATI 425® Alloy, Technical Data Sheet, retrieved from http://web.archive.org/web/20100703120218/http://www.alleghenytechnologies.com/ATI425/specifications/ datasheet.asp, Jul. 3, 2010, Way Back Machine, 5 pages.
ATI 425® Alloy Applications, retrieved from http://web.archive.org/web/20100704044024/http://www.alleghenytechnologies.com/ATI425/applications/default.asp#other, Jul. 4, 2010, Way Back Machine, 2 pages.
Gilbert et al., "Heat Treating of Titanium and Titanium Alloys—Solution Treating and Aging", ASM Handbook, 1991, ASM International, vol. 4, pp. 1-8.
Office Action mailed Feb. 2, 2012 in U.S. Appl. No. 12/691,952.
Office Action mailed Nov. 16, 2011 in U.S. Appl. No. 12/911,947.
Advisory Action mailed Jan. 25, 2012 in U.S. Appl. No. 12/911,947.
Notice of Panel Decision from Pre-Appeal Brief Review mailed Mar. 28, 2012 in U.S. Appl. No. 12/911,947.
Office Action mailed Apr. 5, 2012 in U.S. Appl. No. 12/911,947.
Office Action mailed Sep. 19, 2012 in U.S. Appl. No. 12/911,947.
Advisory Action mailed Nov. 29, 2012 in U.S. Appl. No. 12/911,947.
Office Action mailed Nov. 14, 2012 in U.S. Appl. No. 12/885,620.
Office Action mailed Nov. 14, 2012 in U.S. Appl. No. 12/888,699.
Office Action mailed Oct. 3, 2012 in U.S. Appl. No. 12/838,674.
Veeck, S., et al., "The Castability of Ti-5553 Alloy," Advanced Materials and Processes, Oct. 2004, pp. 47-49.
Murray JL, et al., Binary Alloy Phase Diagrams, Second Edition, vol. 1, Ed. Massalski, Materials Park, OH; ASM International; 1990, p. 547.
Materials Properties Handbook: Titanium Alloys, Eds. Boyer et al, ASM International, Materials Park, OH, 1994, pp. 524-525.
Tamirisakandala et al., "Powder Metallurgy Ti-6AI-4V-xB Alloys: Porcessing, Microstructure, and Properties", JOM, May 2004, pp. 60-63.
Tamirisakandala et al., "Effect of boron on the beta transus of Ti-6Al-4V alloy", Scripta Materialia, 53, 2005, pp. 217-222.
Nutt, Michael J. et al., "The Application of Ti-15 Beta Titanium Alloy in High Strength Structural Orthopaedic Applications," Program and Abstracts for The Symposium on Titanium Nioblum, Zirconium, and Tantalum for Medical and Surgical Applications, Washington, D.C., Nov. 9-10, 2004 Abstract, p. 12.
Marquardt, Brian, "Ti-15Mo Beta Titanium Alloy Processed for High Strength Orthopaedic Applications," Program and Abstracts for The Symposium on Titanium, Niobium, Zirconium, and Tantalum for Medical and Surgical Applications, Washington, D.C., Nov. 9-10, 2004 Abstract, p. 11.
Marquardt, Brian, "Characterization of Ti-15Mo for Orthopaedic Applications," TMS 2005 Annual Meeting: Technical Program, San Francisco, CA, Feb. 13-17, 2005 Abstract, p. 239.
Imperial Metal Industries Limited, Product Specification for "IMI Titanium 205", The Kynoch Press (England) pp. 1-5, (publication date unknown).
Qazi, J.I. et al., "High-Strength Metastable Beta-Titanium Alloys for Biomedical Applications," JOM, Nov. 2004 pp. 49-51.
Tokaji, Keiro et al., "The Microstructure Dependence of Fatigue Behavior in Ti-15Mo-5Zr-3Al Alloy," Materials Science and Engineering A., vol. 213 (1996) pp. 86-92.
Allegheny Ludlum, "High Performance Metals for Industry, High Strength, High Temperature, and Corrosion-Resistant Alloys", (2000) pp. 1-6.
Disegi, John, Wrought Titanium—15% Molybdenum Implant Material, Original Instruments and Implants of the Association for the Study of International Fixation—AO ASIF, Oct. 2003.
SPS Titanium™ Titanium Fasteners, SPS Technologies Aerospace Fasteners, 2003, 4 pages.
Altemp® A286 Iron-Base Superalloy (UNS Designation S66286) Allegheny Ludlum Technical Data Sheet Blue Sheet, 1998, 8 pages.
Zeng et al., Evaluation of Newly Developed Ti-555 High Strength Titanium Fasteners, 17th AeroMat Conference & Exposition, May 18, 2006, 2 pages.
U.S. Appl. No. 12/691,952, filed Jan. 22, 2010.
U.S. Appl. No. 11/745,189, filed May 7, 2007.
Office Action mailed Feb. 20, 2004 in U.S. Appl. No. 10/165,348.
Office Action mailed Oct. 26, 2004 in U.S. Appl. No. 10/165,348.
Office Action mailed Feb. 16, 2005 in U.S. Appl. No. 10/165,348.
Office Action mailed Jul. 25, 2005 in U.S. Appl. No. 10/165,348.
Office Action mailed Jan. 3, 2006 in U.S. Appl. No. 10/165,348.
Offce Action mailed Dec. 16, 2004 in U.S. Appl. No. 10/434,598.
Office Action mailed Aug. 17, 2005 in U.S. Appl. No. 10/434,598.
Office Action mailed Dec. 19, 2005 in U.S. Appl. No. 10/434,596.
Office Action mailed Sep. 6, 2006 in U.S. Appl. No. 10/434,598.
Office Action mailed Aug. 6, 2008 in U.S. Appl. No. 11/448,160.
Office Action mailed Jan. 13, 2009 in U.S. Appl. No. 11/448,160.
Notice of Allowance mailed Apr. 13, 2010 in U.S. Appl. No. 11/448,160.
Notice of Allowance mailed Sep. 20, 2010 in U.S. Appl. No. 11/448,160.
Office Action mailed Sep. 26, 2007 in U.S. Appl. No. 11/057,614.
Office Action mailed Jan. 10, 2008 in U.S. Appl. No. 11/057,614.
Office Action mailed Aug. 29, 2008 in U.S. Appl. No. 11/057,614.
Office Action mailed Aug. 11, 2009 in U.S. Appl. No. 11/057,614.
Office Action mailed Jan. 14, 2010 in U.S. Appl. No. 11/057,614.
Interview summary mailed Apr. 14, 2010 in U.S. Appl. No. 11/057,614.
Office Action mailed Jun. 21, 2010 in U.S. Appl. No. 11/057,614.
Notice of Allowance mailed Sep. 3, 2010 in U.S. Appl. No. 11/057,614.
Office Action mailed Apr. 1, 2010 in U.S. Appl. No. 11/745,189.
Interview summary mailed Jun. 3, 2010 in U.S. Appl. No. 11/745,189.
Interview summary mailed Jun. 15, 2010 in U.S. Appl. No. 11/745,189.
Otfice Action mailed Nov. 24, 2010 in U.S. Appl. No. 11/745,189.
Interview summary mailed Jan. 6, 2011 in U.S. Appl. No. 11/745,189.
Office Action mailed Jan. 11, 2011 in U.S. Appl. No. 12/911,947.
Office Action mailed Jan. 3, 2011 in U.S. Appl. No. 12/857,789.

* cited by examiner

HOT STRETCH STRAIGHTENING OF HIGH STRENGTH α/β PROCESSED TITANIUM

BACKGROUND OF THE TECHNOLOGY

1. Field of the Technology

The present disclosure is directed to methods for straightening high strength titanium alloys aged in the α+β phase field.

2. Description of the Background of the Technology

Titanium alloys typically exhibit a high strength-to-weight ratio, are corrosion resistant, and are resistant to creep at moderately high temperatures. For these reasons, titanium alloys are used in aerospace and aeronautic applications including, for example, landing gear members, engine frames and other critical structural parts. Titanium alloys also are used in jet engine parts such as rotors, compressor blades, hydraulic system parts, and nacelles.

In recent years, β-titanium alloys have gained increased interest and application in the aerospace industry. β-titanium alloys are capable of being processed to very high strengths while maintaining reasonable toughness and ductility properties. In addition, the low flow stress of β-titanium alloys at elevated temperatures can result in improved processing.

However, β-titanium alloys can be difficult to process in the α+β phase field because, for example, the alloys' β-transus temperatures are typically in the range of 1400° F. to 1600° F. (760° C. to 871.1° C.). In addition, fast cooling, such as water or air quenching, is required after α+β solution treating and aging in order to achieve the desired mechanical properties of the product. A straight α+β solution treated and aged β-titanium alloy bar, for example, may warp and/or twist during quenching. ("Solution treated and aged" is referred to at times herein as "STA".) In addition, the low aging temperatures that must be used for the β-titanium alloys, e.g., 890° F. to 950° F. (477° C. to 510° C.), severely limit the temperatures that can be used for subsequent straightening. Final straightening must occur below the aging temperature to prevent significant changes in mechanical properties during straightening operations.

For α+β titanium alloys, such as, for example, Ti-6Al-4V alloy, in long product or bar form, expensive vertical solution heat treating and aging processes are conventionally employed to minimize distortion. A typical example of the prior art STA processing includes suspending a long part, such as a bar, in a vertical furnace, solution treating the bar at a temperature in the α+β phase field, and aging the bar at a lower temperature in the α+β phase field. After fast quenching, e.g., water quenching, it may be possible to straighten the bar at temperatures lower than the aging temperature. Suspended in a vertical orientation, the stresses in the rod are more radial in nature and result in less distortion. An STA processed Ti-6Al-4V alloy (UNS R56400) bar can then be straightened by heating to a temperature below the aging temperature in a gas furnace, for example, and then straightened using a 2-plane, 7-plane, or other, straightener known to a person of ordinary skill. However, vertical heat treatment and water quenching operations are expensive and the capabilities are not found in all titanium alloy manufacturers Because of the high room temperature strength of solution treated and aged β-titanium alloys, conventional straightening methods, such as vertical heat treating, are not effective for straightening long product, such as bar. After aging between 800° F. to 900° F. (427° C. to 482° C.), for example, STA metastable β-titanium Ti-15Mo alloy (UNS R58150) can have an ultimate tensile strength of 200 ksi (1379 MPa) at room temperature. Therefore, STA Ti-15Mo alloy does not lend itself to traditional straightening methods because the available straightening temperatures that would not affect mechanical properties are low enough that a bar composed of the alloy could shatter as straightening forces are applied.

Accordingly, a straightening process for solution treated and aged metals and metal alloys that does not significantly affect the strength of the aged metal or metal alloy is desirable.

SUMMARY

According to one aspect of the present disclosure, a non-limiting embodiment of a method for straightening an age hardened metallic form selected from one of a metal and a metal alloy includes heating an age hardened metallic form to a straightening temperature. In certain embodiments, the straightening temperature is in a straightening temperature range from 0.3 of the melting temperature in kelvin (0.3 Tm) of the age hardened metallic form to at least 25° F. (13.9° C.) below an aging temperature used to harden the age hardened metallic form. An elongation tensile stress is applied to the age hardened metallic form for a time sufficient to elongate and straighten the age hardened metallic form to provide a straightened age hardened metallic form. The straightened age hardened metallic form deviates from straight by no greater than 0.125 inch (3.175 mm) over any 5 foot length (152.4 cm) or shorter length. The straightened age hardened metallic form is cooled while simultaneously applying a cooling tensile stress to the straightened age hardened metallic form that is sufficient to balance the thermal cooling stresses in the alloy and maintain a deviation from straight of no greater than 0.125 inch (3.175 mm) over any 5 foot length (152.4 cm) or shorter length of the straightened age hardened metallic form.

A method for straightening a solution treated and aged titanium alloy form includes heating a solution treated and aged titanium alloy form to a straightening temperature. The straightening temperature comprises a straightening temperature in the α+β phase field of the solution treated and aged titanium alloy form. In certain embodiments, the straightening temperature range is 1100° F. (611.1° C.) below a beta transus temperature of the solution treated and aged titanium alloy form to 25° F. (13.9° C.) below the age hardening temperature of the solution treated and aged titanium alloy form. An elongation tensile stress is applied to the solution treated and aged titanium alloy form for a time sufficient to elongate and straighten the solution treated and aged titanium alloy form to form a straightened solution treated and aged titanium alloy form. The straightened solution treated and aged titanium alloy form deviates from straight by no greater than 0.125 inch (3.175 mm) over any 5 foot length (152.4 cm) or shorter length. The straightened solution treated and aged titanium alloy form is cooled while simultaneously applying a cooling tensile stress to the straightened solution treated and aged titanium alloy form. The cooling tensile stress is sufficient to balance a thermal cooling stress in the straightened solution treated and aged titanium alloy form and maintain a deviation from straight of no greater than 0.125 inch (3.175 mm) over any 5 foot length (152.4 cm) or shorter length of the straightened solution treated and aged titanium alloy form.

BRIEF DESCRIPTION OF THE DRAWINGS

The features and advantages of methods described herein may be better understood by reference to the accompanying drawings in which.

The reader will appreciate the foregoing details, as well as others, upon considering the following detailed description of certain non-limiting embodiments of methods according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in the methods according to the present disclosure. At the very least, and not as an attempt to limit the application of the doctrine of equivalents to the scope of the claims, each numerical parameter should at least be construed in light of the number of reported significant digits and by applying ordinary rounding techniques.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

Figure 1:
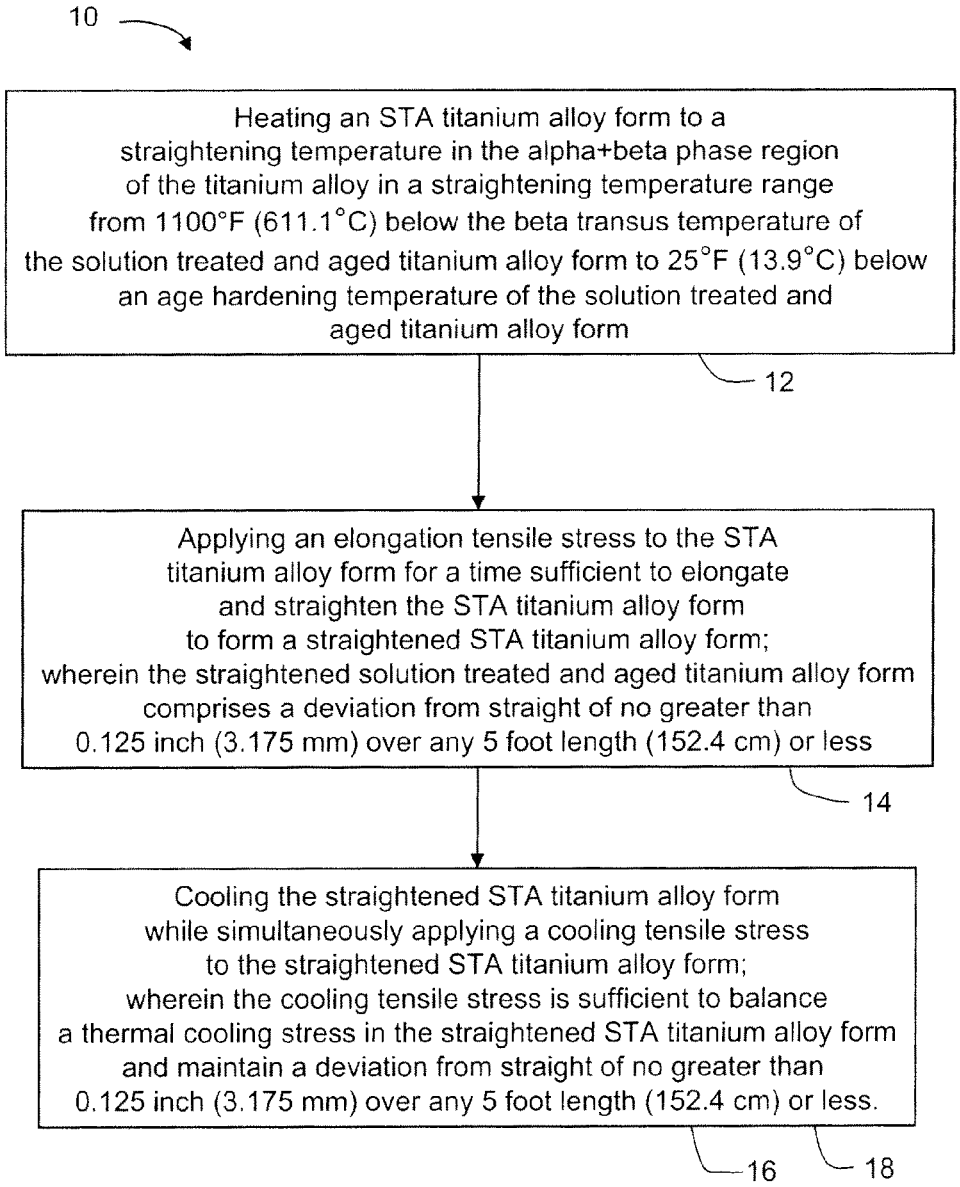
FIG. 1 is a flow diagram of a non-limiting embodiment of a hot stretch straightening method for titanium alloy forms according to the present disclosure.

Referring now to the flow diagram of FIG. 1, a non-limiting embodiment of a hot stretch straightening method 10 for straightening a solution treated and aged titanium alloy form according to the present disclosure comprises heating 12 a solution treated and aged titanium alloy form to a straightening temperature. In a non-limiting embodiment, the straightening temperature is a temperature within the $\alpha+\beta$ phase field. In another non-limiting embodiment, the straightening temperature is in a straightening temperature range from about 1100° F. (611.1° C.) below the beta transus temperature of the titanium alloy to about 25° below the age hardening temperature of the solution treated and aged alloy form.

As used herein, "solution treated and aged" (STA) refers to a heat treating process for titanium alloys that includes solution treating a titanium alloy at a solution treating temperature in the two-phase region, i.e., in the $\alpha+\beta$ phase field of the titanium alloy. In a non-limiting embodiment, the solution treating temperature is in a range from about 50° F. (27.8° C.) below the $\beta$-transus temperature of the titanium alloy to about 200° F. (111.1° C.) below the $\beta$-transus temperature of the titanium alloy. In another non-limiting embodiment, a solution treatment time ranges from 30 minutes to 2 hours. It is recognized that in certain non-limiting embodiments, the solution treatment time may be shorter than 30 minutes or longer than 2 hours and is generally dependent upon the size and cross-section of the titanium alloy form. This two-phase region solution treatment dissolves much of the $\alpha$-phase present in the titanium alloy, but leaves some $\alpha$-phase remaining, which pins grain growth to some extent. Upon completion of the solution treatment, the titanium alloy is water quenched so that a significant portion of alloying elements is retained in the $\beta$-phase.

The solution treated titanium alloy is then aged at an aging temperature, also referred to herein as an age hardening temperature, in the two-phase field, ranging from 400° F. (222.2° C.) below the solution treating temperature to 900° F. (500° C.) below the solution treating temperature for an aging time sufficient to precipitate fine grain $\alpha$-phase. In a non-limiting embodiment, the aging time may range from 30 minutes to 8 hours. It is recognized that in certain non-limiting embodiments, the aging time may be shorter than 30 minutes or longer than 8 hours longer and is generally dependent upon the size and cross-section of the titanium alloy form. The STA process produces titanium alloys exhibiting high yield strength and high ultimate tensile strength. The general techniques used in STA processing an alloy are known to practitioners of ordinary skill in the art and, therefore, are not further elaborated herein.

Referring again to FIG. 1, after heating 12, an elongation tensile stress is applied 14 to the STA titanium alloy form for a time sufficient to elongate and straighten the STA titanium alloy form and provide a straightened STA titanium alloy form. In a non-limiting embodiment, the elongation tensile stress is at least about 20% of the yield stress of the STA titanium alloy form at the straightening temperature and not equivalent to or greater than the yield stress of the STA titanium alloy form at the straightening temperature. In a non-limiting embodiment, the applied elongation tensile stress may be increased during the straightening step in order to maintain elongation. In a non-limiting embodiment, the elongation tensile stress is increased by a factor of 2 during elongation. In a non-limiting embodiment, the STA titanium alloy product form comprises Ti-10V-2Fe-3Al alloy (UNS 56410), which has a yield strength of about 60 ksi at 900° F. (482.2° C.), and the applied elongation stress is about 12.7 ksi at 900° F. at the beginning of straightening and about 25.5 ksi at the end of the elongation step.

In another non-limiting embodiment, after applying the elongation tensile stress 14, the straightened STA titanium alloy form deviates from straight by no greater than 0.125 inch (3.175 mm) over any 5 foot length (152.4 cm) or shorter length.

It is recognized that it is within the scope of non-limiting embodiments of this disclosure that the elongation tensile stress could be applied while allowing the form to cool. It will be understood, however, that because stress is a function of temperature, as the temperature decreases the required elongation stress would have to be increased to continue to elongate and straighten the form.

In a non-limiting embodiment, when the STA titanium alloy form is sufficiently straightened, the STA titanium alloy form is cooled 16 while simultaneously applying a cooling tensile stress 18 to the straightened solution treated and aged titanium alloy form. In a non-limiting embodiment, the cooling tensile stress is sufficient to balance a thermal cooling stress in the straightened STA titanium alloy form so that the STA titanium alloy form does not warp, curve, or otherwise distort during cooling. In a non-limiting embodiment, the cooling stress is equivalent to the elongation stress. It is recognized that because the temperature of the product form decreases during cooling, applying a cooling tensile stress that is equivalent to the elongation tensile stress will not cause further elongation of the product form, but does serve to prevent cooling stresses in the product form from warping the product form and maintains the deviation from straight that was established in the elongation step.

In a non-limiting embodiment, the cooling tensile stress is sufficient to maintain a deviation from straight of no greater than 0.125 inch (3.175 mm) over any 5 foot length (152.4 cm) or shorter length of the straightened STA titanium alloy form.

In a non-limiting embodiment, the elongation tensile stress and the cooling tensile stress are sufficient to enable creep forming of the STA titanium alloy form. Creep forming takes place in the normally elastic regime. While not wanting to be bound by any particular theory, it is believed that the applied stress in the normally elastic regime at the straightening temperature allows grain boundary sliding and dynamic dislocation recovery that results in straightening of the product form. After cooling and compensating for the thermal cooling stresses by maintaining a cooling tensile stress on the product form, the moved dislocations and grain boundaries assume the new elastic state of the STA titanium alloy product form.

Figure 2:
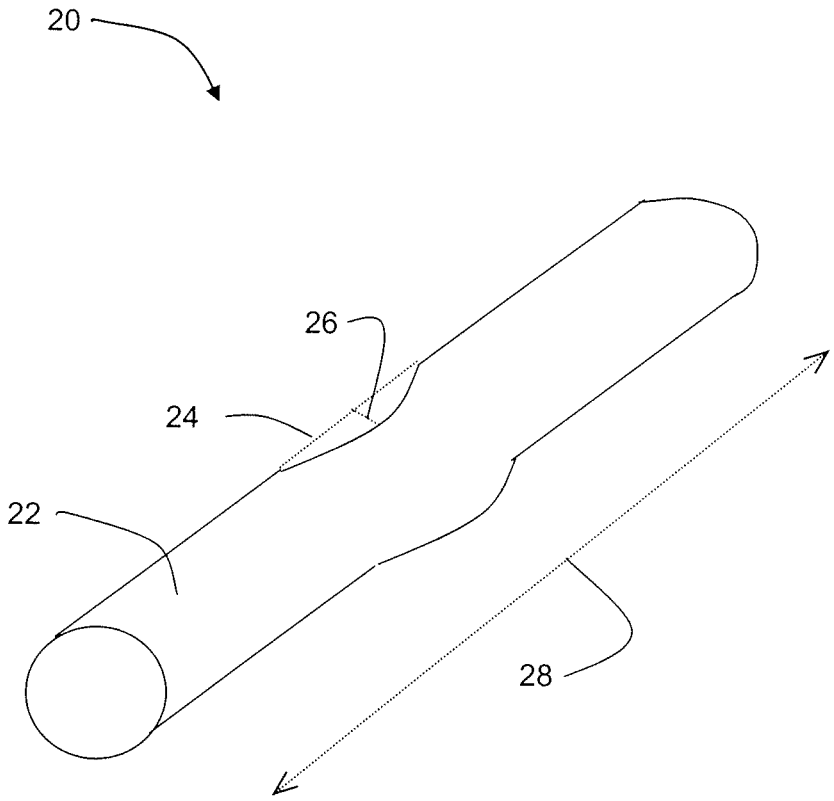
FIG. 2 is a schematic representation for measuring deviation from straight of metallic bar material.

Referring to FIG. 2, in a method 20 for determining the deviation from straight of a product form, such as, for example, a bar 22, the bar 22 is lined up next to a straight edge 24. The curvature of the bar 22 is measured at curved or twisted locations on the bar with a device used to measure length, such as a tape measure, as the distance the bar curves away from the straight edge 24. The distance of each twist or curve from the straight edge is measured along a prescribed length of the bar 28 to determine the maximum deviation from straight (26 in FIG. 2), i.e., the maximum distance of the bar 22 from the straight edge 24 within the prescribed length of the bar 22. The same technique may be used to quantify deviation from straight for other product forms.

In another non-limiting embodiment, after applying the elongation tensile stress according to the present disclosure, the straightened STA titanium alloy form deviates from straight by no greater than 0.094 inch (2.388 mm) over any 5 foot length (152.4 cm) or shorter length of the straightened STA titanium alloy form. In yet another non-limiting embodiment, after cooling while applying the cooling tensile stress according to the present disclosure, the straightened STA titanium alloy form deviates from straight by no greater than 0.094 inch (2.388 mm) over any 5 foot length (152.4 cm) or shorter length of the straightened STA titanium alloy form. In still another non-limiting embodiment, after applying the elongation tensile stress according to the present disclosure, the straightened STA titanium alloy form deviates from straight by no greater than 0.25 inch (6.35 mm) over any 10 foot length (304.8 cm) or shorter length of the straightened STA titanium alloy form. In still another non-limiting embodiment, after cooling while applying the cooling tensile stress according to the present disclosure, the straightened STA titanium alloy form deviates from straight by no greater than 0.25 inch (6.35 mm) over any 10 foot length (304.8 cm) or shorter length of the straightened STA titanium alloy form.

In order to uniformly apply the elongation and cooling tensile stresses, in a non-limiting embodiment according to the present disclosure, the STA titanium alloy form must be capable of being gripped securely across the entire cross-section of the STA titanium alloy form. In a non-limiting embodiment, the shape of the STA titanium alloy form can be the shape of any mill product for which adequate grips can be fabricated to apply a tensile stress according to the method of the present disclosure. A "mill product" as used herein is any metallic, i.e., metal or metal alloy, product of a mill that is subsequently used as-fabricated or is further fabricated into an intermediate or finished product. In a non-limiting embodiment an STA titanium alloy form comprises one of a billet, a bloom, a round bar, a square bar, an extrusion, a tube, a pipe, a slab, a sheet, and a plate. Grips and machinery for applying the elongating and cooling tensile stresses according to the present disclosure are available from, for example, Cyril Bath Co., Monroe, N.C., USA.

A surprising aspect of this disclosure is the ability to hot stretch straighten STA titanium alloy forms without significantly reducing the tensile strengths of the STA titanium alloy forms. For example, in a non-limiting embodiment, the average yield strength and average ultimate tensile strength of the hot stretch straightened STA titanium alloy form according to non-limiting methods of this disclosure are reduced by no more than 5 percent from values before hot stretch straightening. The largest change in properties produced by hot stretch straightening that was observed was in percent elongation. For example, in a non-limiting embodiment according to the present disclosure, the average value for percent elongation of a titanium alloy form exhibited an absolute reduction of about 2.5% after hot stretch straightening. Without intending to be bound by any theory of operation, it is believed that a decrease in percent elongation may occur due to the elongation of the STA titanium alloy form that occurs during non-limiting embodiments of hot stretch straightening according to this disclosure. For example, in a non-limiting embodiment, after hot stretch straightening the present disclosure, a straightened STA titanium alloy form may be elongated by about 1.0% to about 1.6% versus the length of the STA titanium alloy form prior to hot stretch straightening.

Heating the STA titanium alloy form to a straightening temperature according to the present disclosure may employ any single or combination of forms of heating capable of maintaining the straightening temperature of the bar, such as, but not limited to, heating in a box furnace, radiant heating, and induction heating the form. The temperature of the form must be monitored to ensure that the temperature of the form remains at least 25° F. (13.9° C.) below the aging temperature used during the STA process. In non-limiting embodiments, the temperature of the form is monitored using thermocouples or infrared sensors. However, other means of heating and monitoring the temperature known to persons of ordinary skill in the art are within the scope of this disclosure.

In one non-limiting embodiment, the straightening temperature of the STA titanium alloy form should be relatively uniform throughout and should not vary from location to location by more than 100° F. (55.6° C.). The temperature at any location of the STA titanium alloy form preferably does not increase above the STA aging temperature, because the mechanical properties, including, but not limited to the yield strength and ultimate tensile strength, could be detrimentally affected.

The rate of heating the STA titanium alloy form to the straightening temperature is not critical, with the precaution that faster heating rates could result in overrun of the straightening temperature and result in loss of mechanical properties. By taking precautions not to overrun the target straightening temperature, or not to overrun a temperature at least 25° F. (13.9° C.) below the STA aging temperature, faster heating rates can result in shorter straightening cycle times between parts, and improved productivity. In a non-limiting embodiment, heating to the straightening temperature comprises heating at a heating rate from 500° F./min (277.8° C./min) to 1000° F./min (555.6° C./min).

Any localized area of the STA titanium alloy form preferably should not reach a temperature equal to or greater than the STA aging temperature. In a non-limiting embodiment, the temperature of the form should always be at least 25° F. (13.9° C.) below the STA aging temperature. In a non-limiting embodiment, the STA aging temperature (also variously referred to herein as the age hardening temperature, the age hardening temperature in the α+β phase field, and the aging temperature) may be in a range of 500° F. (277.8° C.) below the β-transus temperature of the titanium alloy to 900° F. (500° C.) below the β-transus temperature of the titanium alloy. In other non-limiting embodiments, the straightening temperature is in a straightening temperature range of 50° F. (27.8° C.) below the age hardening temperature of the STA titanium alloy form to 200° F. (111.1° C.) below the age hardening temperature of the STA titanium alloy form, or is in a straightening temperature range of 25° F. (13.9° C.) below the age hardening temperature to 300° F. (166.7° C.) below the age hardening temperature.

A non-limiting embodiment of a method according to the present disclosure comprises cooling the straightened STA titanium alloy form to a final temperature at which point the cooling tensile stress can be removed without changing the deviation from straight of the straightened STA titanium alloy form. In a non-limiting embodiment, cooling comprises cooling to a final temperature no greater than 250° F. (121.1° C.). The ability to cool to a temperature higher than room temperature while being able to relieve the cooling tensile stress without deviation in straightness of the STA titanium alloy form allows for shorter straightening cycle times between parts and improved productivity. In another non-limiting embodiment, cooling comprises cooling to room temperature, which is defined herein as about 64° F. (18° C.) to about 77° F. (25° C.).

As will be seen, an aspect of this disclosure is that certain non-limiting embodiments of hot stretch straightening disclosed herein can be used on substantially any metallic form comprising many, if not all, metals and metal alloys, including, but not limited to, metals and metal alloys that are conventionally considered to be hard to straighten. Surprisingly, non-limiting embodiments of the hot stretch straightening method disclosed herein were effective on titanium alloys that are conventionally considered to be hard to straighten. In a non-limiting embodiment within the scope of this disclosure, the titanium alloy form comprises a near α-titanium alloy. In a non-limiting embodiment, the titanium alloy form comprises at least one of Ti-8Al-1Mo-1V alloy (UNS 54810) and Ti-6Al-2Sn-4Zr-2Mo alloy (UNS R54620).

In a non-limiting embodiment within the scope of this disclosure, the titanium alloy form comprises an α+β-titanium alloy. In another non-limiting embodiment, the titanium alloy form comprises at least one of Ti-6Al-4V alloy (UNS R56400), Ti-6Al-4V ELI alloy (UNSR56401), Ti-6Al-2Sn-4Zr-6Mo alloy (UNS R56260), Ti-5Al-2Sn-2Zr-4Mo-4Cr alloy (UNS R58650), and Ti-6Al-6V-2Sn alloy (UNS R56620).

In still another non-limiting embodiment, the titanium alloy form comprises a β-titanium alloy. A "β-titanium alloy", as used herein, includes, but is not limited to, near β-titanium alloys and metastable β-titanium alloys. In a non-limiting embodiment, the titanium alloy form comprises one of Ti-10V-2Fe-3Al alloy (UNS 56410), Ti-5Al-5V-5Mo-3Cr alloy (UNS unassigned), Ti-5Al-2Sn-4Mo-2Zr-4Cr alloy (UNS R58650), and Ti-15Mo alloy (UNS R58150). In a specific non-limiting embodiment, the titanium alloy form is a Ti-10V-2Fe-3Al alloy (UNS 56410) form.

It is noted that with certain β-titanium alloys, for example, Ti-10V-2Fe-3Al alloy, it is not possible to straighten STA forms of these alloys to the tolerances disclosed herein using conventional straightening processes, while also maintaining the desired mechanical properties of the alloy. For β-titanium alloys, the β transus temperature is inherently lower than commercially pure titanium. Therefore, the STA aging temperature also must be lower. In addition, STA β-titanium alloys such as, but not limited to, Ti-10V-2Fe-3Al alloy can exhibit ultimate tensile strengths higher than 200 ksi (1379 MPa). When attempting to straighten STA β-titanium alloy bars having such high strengths using conventional stretching methods, such as using a two-plane straightener, at temperatures no greater than 25° F. (13.9° C.) below the STA aging temperature, the bars exhibit a strong tendency to shatter. Surprisingly, it has been discovered that these high strength STA β-titanium alloys can be straightened to the tolerances disclosed herein using non-limiting hot stretch straightening method embodiments according to this disclosure without fracturing and with only an average loss of yield and ultimate tensile strengths of about 5%.

While the discussion hereinabove is concerned primarily with straightened titanium alloy forms and methods of straightening STA titanium alloy forms, non-limiting embodiments of hot stretch straightening disclosed herein may be used successfully on virtually any age hardened metallic product form, i.e., a metallic product comprising any metal or metal alloy.

Figure 3:
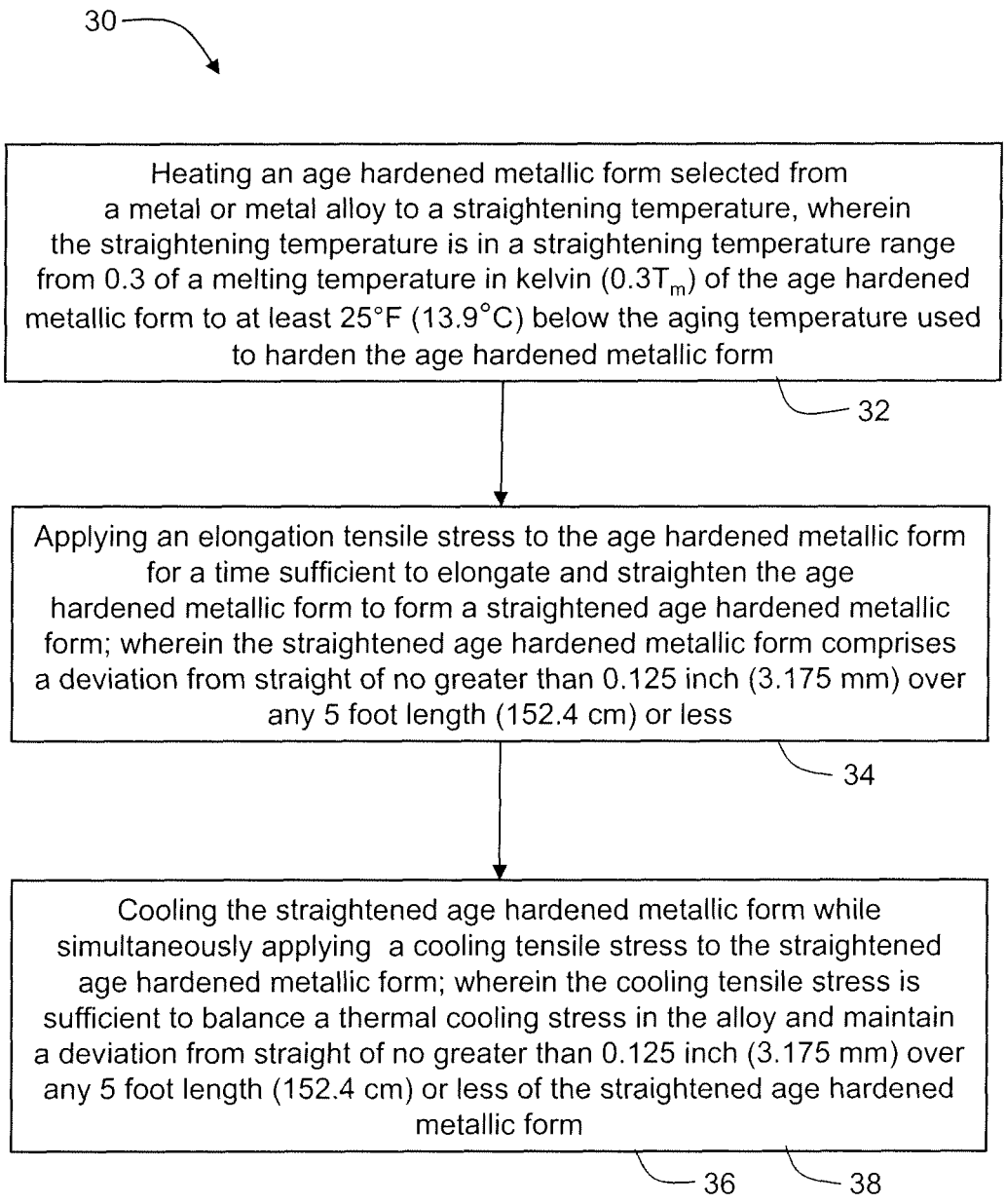
FIG. 3 is a flow diagram of a non-limiting embodiment of a hot stretch straightening method for metallic product forms according to the present disclosure.

Referring to FIG. 3, in a non-limiting embodiment according to the present disclosure, a method 30 for straightening a solution treated and age hardened metallic form including one of a metal and a metal alloy comprises heating 32 a solution treated and age hardened metallic form to a straightening temperature in a straightening temperature range from 0.3 of a melting temperature in kelvin (0.3 $T_m$) of the age hardened metallic form to a temperature of at least 25° F. (13.9° C.) below the aging temperature used to harden the age hardened metallic form.

A non-limiting embodiment according to the present disclosure comprises applying 34 an elongation tensile stress to a solution treated and age hardened metallic form for a time sufficient to elongate and straighten the age hardened metallic form to provide a straightened age hardened metallic form. In a non-limiting embodiment, the elongation tensile stress is at least about 20% of the yield stress of the age hardened metallic form at the straightening temperature and is not equivalent to or greater than the yield stress of the STA titanium alloy form at the straightening temperature. In a non-limiting embodiment, the applied elongation tensile stress may be increased during the straightening step in order to maintain elongation. In a non-limiting embodiment, the elongation tensile stress is increased by a factor of 2 during elongation. In a non-limiting embodiment, the straightened age hardened metallic form deviates from straight by no greater than 0.125 inch (3.175 mm) over any 5 foot length (152.4 cm) or shorter length. In a non-limiting embodiment, the straightened age hardened metallic form deviates from straight by no greater than 0.094 inch (2.388 mm) over any 5 foot length (152.4 cm) or shorter length of the straightened age hardened metallic form. In still another non-limiting embodiment, the straightened age hardened metallic form deviates from straight by no greater than 0.25 inch (6.35 mm) over any 10 foot (304.8 cm) length of the straightened age hardened metallic form.

A non-limiting embodiment according to the present disclosure comprises cooling 36 the straightened age hardened metallic form while simultaneously applying 38 a cooling tensile stress to the straightened age hardened metallic form. In another non-limiting embodiment, the cooling tensile stress is sufficient to balance a thermal cooling stress in the straightened age hardened metallic form so that the straightened age hardened metallic form does not warp, curve, or otherwise distort during cooling. In a non-limiting embodiment, the cooling stress is equivalent to the elongation stress. It is recognized that because the temperature of the product form decreases during cooling, applying a cooling tensile stress that is equivalent to the elongation tensile stress will not cause further elongation of the product form, but does serve to prevent cooling stresses in the product form from warping the product form and maintains the deviation from straight that was established in the elongation step. In another non-limiting embodiment, the cooling tensile stress is sufficient to balance a thermal cooling stress in the alloy so that the age hardened metallic form does not warp, curve, or otherwise distort during cooling. In still another non-limiting embodiment, the cooling tensile stress is sufficient to balance a thermal cooling stress in the alloy so that the age hardened metallic form maintains a deviation from straight of no greater than 0.125 inch (3.175 mm) over any 5 foot length (152.4 cm) or shorter length of the straightened age hardened metallic form. In yet another non-limiting embodiment, the cooling stress is sufficient to balance a thermal cooling stress in the alloy so that the age hardened metallic form maintains a deviation from straight of no greater than 0.094 inch (2.388 mm) over any 5 foot length (152.4 cm) or shorter length. In yet another non-limiting embodiment, the cooling stress is sufficient to balance a thermal cooling stress in the alloy so that the age hardened metallic form maintains a deviation from straight of no greater than 0.25 inch (6.35 mm) over any 10 foot (304.8 cm) length of the straightened age hardened metallic form.

In various non-limiting embodiments according to the present disclosure, the solution treated and age hardened metallic form comprises one of a titanium alloy, a nickel alloy, an aluminum alloy, and a ferrous alloy. Also, in certain non-limiting embodiments according to the present disclosure, the solution treated and age hardened metallic form is selected from a billet, a bloom, a round bar, a square bar, an extrusion, a tube, a pipe, a slab, a sheet, and a plate.

In a non-limiting embodiment according to the present disclosure, the straightening temperature is in a range from 200° F. (111.1° C.) below the age hardening temperature used to harden the age hardened metallic form up to 25° F. (13.9° C.) below the age hardening temperature used to harden the age hardened metallic form.

The examples that follow are intended to further describe certain non-limiting embodiments, without restricting the scope of the present invention. Persons having ordinary skill in the art will appreciate that variations of the following examples are possible within the scope of the invention, which is defined solely by the claims.

EXAMPLE 1

In this comparative example, several 10 foot long bars of Ti-10V-2Fe-3Al alloy were fabricated and processed using several permutations of solution treating, aging, and conventional straightening in an attempt to identify a robust process to straighten the bars. The bars ranged in diameter from 0.5 inch to 3 inches (1.27 cm to 7.62 cm). The bars were solution treated at temperatures from 1375° F. (746.1° to 1475° F. (801.7° C.). The bars were then aged at aging temperature ranging from 900° F. (482.2° C.) to 1000° F. (537.8° C.). Processes evaluated for straightening included: (a) vertical solution treatment and 2-plane straightening below the aging temperature; (b) vertical solution heat treatment followed by 2-plane straightening at 1400° F. (760° C.), aging, and 2-plane straightening at 25° F. (13.9° F.) below the aging temperature; (c) straightening at 1400° F. (760° C.) followed by vertical solution treatment and aging, and 2-plane straightening at 25° F. (13.9° C.) below the aging temperature; (d) high temperature solution heat treating followed by 2-plane straightening at 1400° F. (760° C.), vertical solution treating and aging, and 2-plane straightening at 25° F. (13.9° C.) below the aging temperature; and (e) mill annealing followed by 2-plane straightening at 1100° F. (593.3° C.), vertical solution heat treating, and 2-plane straightening at 25° F. (13.9° C.) below the aging temperature.

The processed bars were visually inspected for straightness and were graded as either passing or failing. It was observed that the process labeled (e) was the most successful. All attempts using vertical STA heat treatments, however, had no more than a 50% passing rate.

EXAMPLE 2

Figure 4:
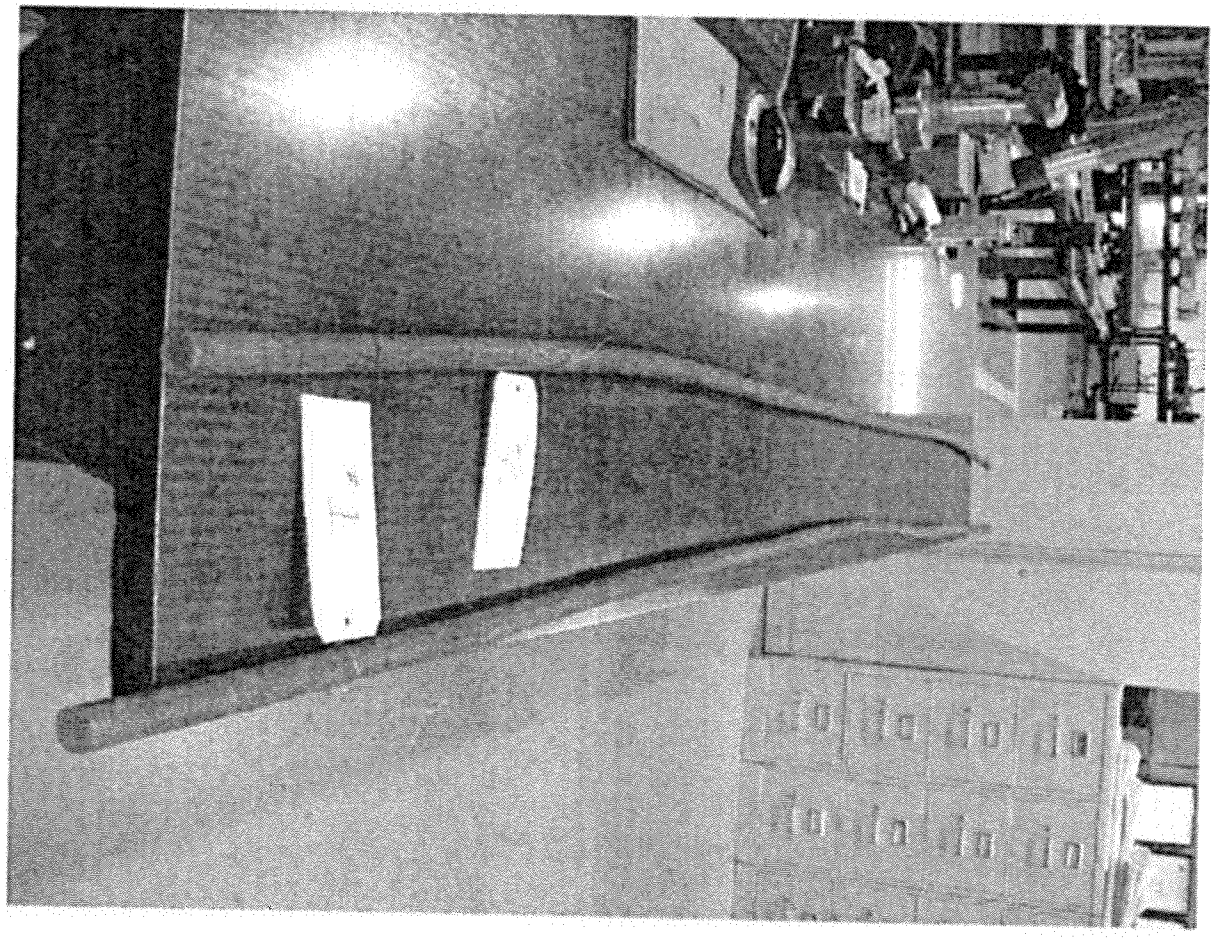
FIG. 4 is a photograph of solution treated and aged bars of Ti-10V-2Fe-3Al alloy.

Two 1.875 inch (47.625 mm) diameter, 10 foot (3.048 m) bars of Ti-10V-2Fe-3Al alloy were used for this example. The bars were rolled at a temperature in the $\alpha+\beta$ phase field from rotary forged re-roll that was produced from upset and single recrystallized billet. Elevated temperature tensile tests at 900° F. (482.2° C.) were performed to determine the maximum diameter of bar that could be straightened with the available equipment. The elevated temperature tensile tests indicated that a 1.0 inch (2.54 cm) diameter bar was within the equipment limitations. The bars were peeled to 1.0 inch (2.54 cm) diameter bars. The bars were then solution treated at 1460° F. (793.3° C.) for 2 hours and water quenched. The bars were aged for 8 hours at 940° F. (504.4° C.). The straightness of the bars was measured to deviate approximately 2 inch (5.08 cm) from straight with some twist and wave. The STA bars exhibited two different types of bow. The first bar (Serial #1) was observed to be relatively straight at the ends and had a gentle bow to the middle of approximately 2.1 inch (5.334 cm) from straight. The second bar (Serial #2) was fairly straight near the middle, but had kinks near the ends. The maximum deviation from straight was around 2.1 inch (5.334 cm). The surface finish of the bars in the as-quenched condition exhibited a fairly uniform oxidized surface. FIG. 4 is a representative photograph of the bars after solution treating and aging.

EXAMPLE 3

The solution treated and aged bars of Example 2 were hot stretch straightened according to a non-limiting embodiment of this disclosure. The temperature feedback for the control of bar temperature was via a thermocouple located at the middle of the part. However, to address inherent difficulties with thermocouple attachment, two additional thermocouples were welded to the parts near their ends.

The first bar experienced a failed main control thermocouple, resulting in oscillations during the heat ramp. This, along with another control anomaly, led to the part exceeding the desired temperature of 900° F. (482.2° C.). The high temperature achieved was approximately 1025° F. (551.7° C.) for less than 2 minutes. The first bar was re-instrumented with another thermocouple, and a similar overshoot occurred due to an error in the software control program from the previous run. The first bar was heated with the maximum power permitted, which can heat a bar of the size used in this example from room temperature to 1000° F. (537.8° C.) in approximately 2 minutes.

Figure 5:
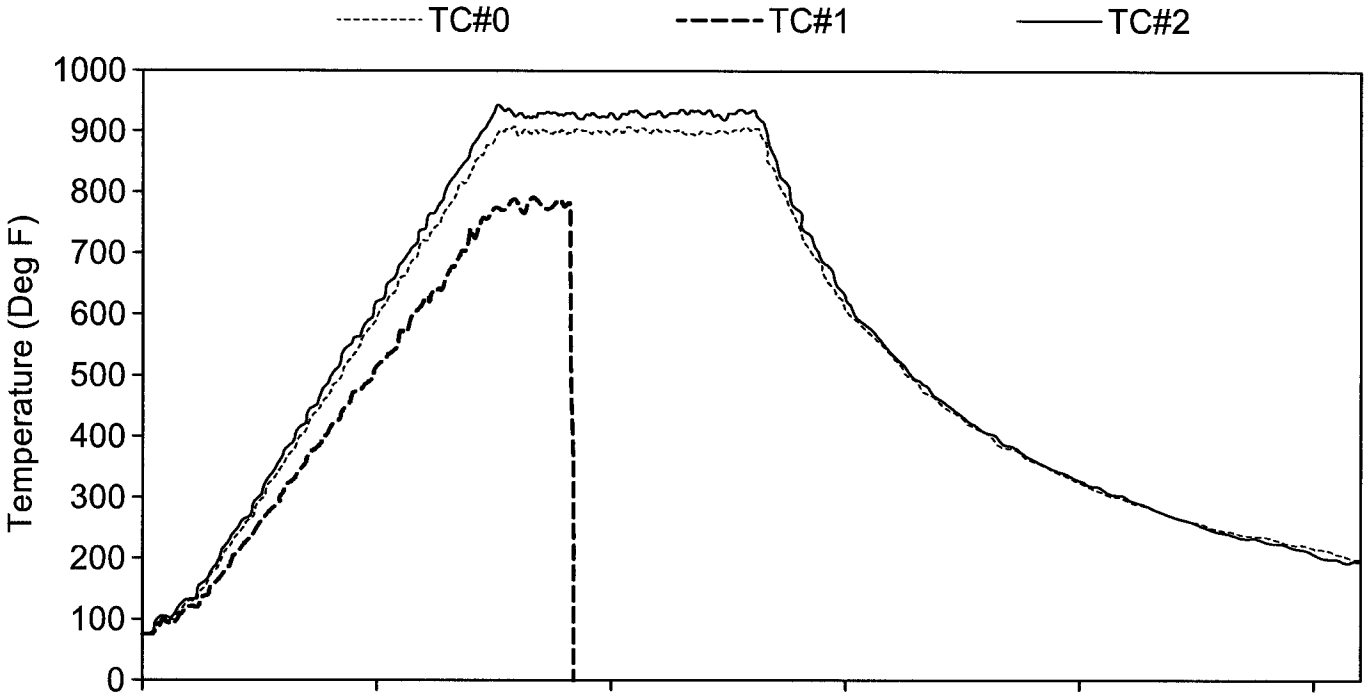
FIG. 5 is a temperature versus time chart for straightening Serial #1 bar of the non-limiting example of Example 7.

The program was reset and the first bar straightening program was allowed to proceed. The highest temperature recorded was 944° F. (506.7° C.) by thermocouple number 2 (TC#2), which was positioned near one end of the bar. It is believed that TC#2 experienced a mild hot junction failure when under power. During this cycle, thermocouple number 0 (TC#0), positioned in the center of the bar, recorded a maximum temperature of 908° F. (486.7° C.). During the straightening, thermocouple number 1 (TC#1), positioned near the opposite end of the bar from TC#2, fell off the bar and discontinued reading the bar temperature. The temperature graph for this final heat cycle on bar Serial #1 is shown in FIG. 5. The cycle time for the first bar (Serial #1) was 50 minutes. The bar was cooled to 250° F. (121.1° C.) while maintaining the tonnage on the bar that was applied at the end of the elongation step.

The first bar was elongated 0.5 inch (1.27 cm) over the span of 3 minutes. The tonnage during that phase was increased from 5 tons (44.5 kN) initially to 10 tons (89.0 kN) after completion. Because the bar has a 1 inch (2.54 cm) diameter, these tonnages translate to tensile stresses of 12.7 ksi (87.6 MPa) and 25.5 ksi (175.8 MPa). The part had also experienced elongation in the previous heat cycles that were discontinued due to temperature control failure. The total measured elongation after straightening was 1.31 inch (3.327 cm).

Figure 6:
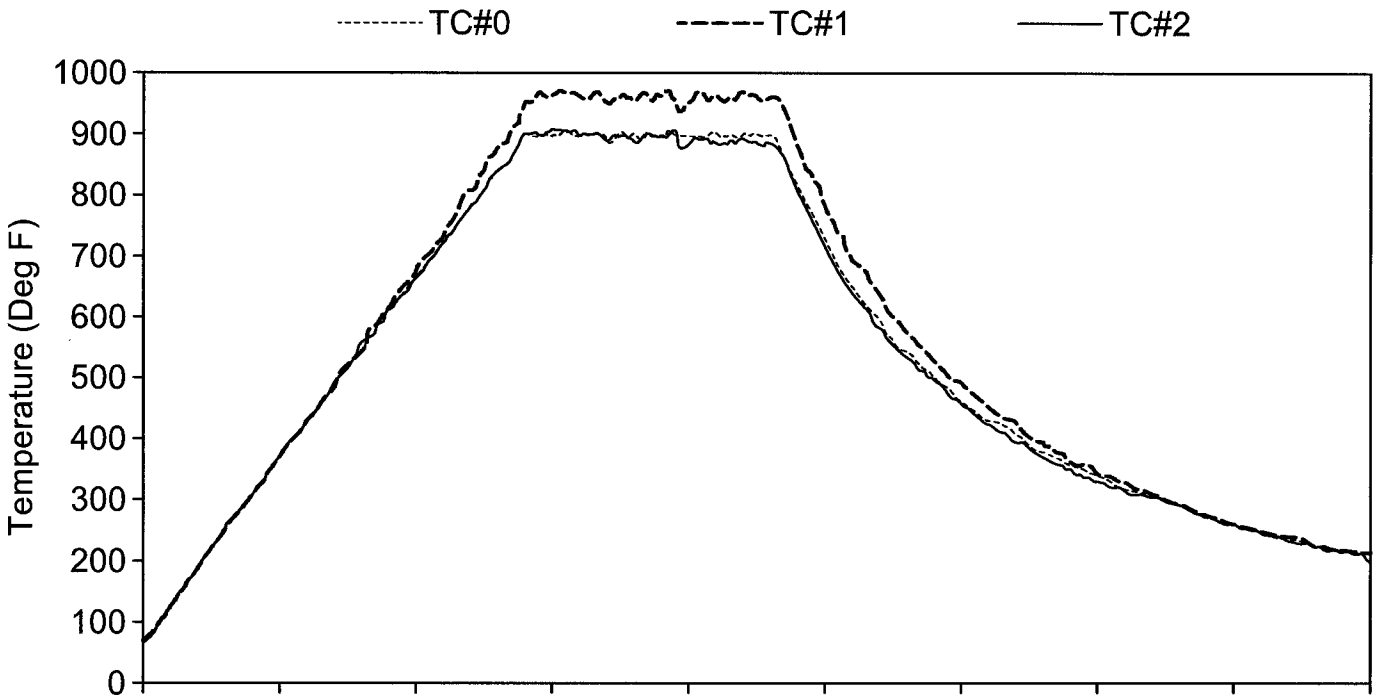
FIG. 6 is a temperature versus time chart for straightening Serial #2 bar of the non-limiting example of Example 7.

The second bar (Serial #2) was carefully cleaned near the thermocouple attachment points and the thermocouples were attached and inspected for obvious defects. The second bar was heated to a target set point of 900° F. (482.2° C.). TC#1 recorded a temperature of 973° F. (522.8° C.), while TC#0 and TC#2 recorded temperatures of only 909° F. (487.2° C.) and 911° F. (488.3° C.), respectively. TC#1 tracked well with the other two thermocouples until around 700° F. (371.1° C.), at which point some deviation was observed, as seen in FIG. 6. Once again, the attachment of the thermocouple was suspected to be the source of the deviation. The total cycle time for this part was 45 minutes. The second bar (Serial #2) was hot stretched as described for the first bar (Serial #1).

Figure 7:
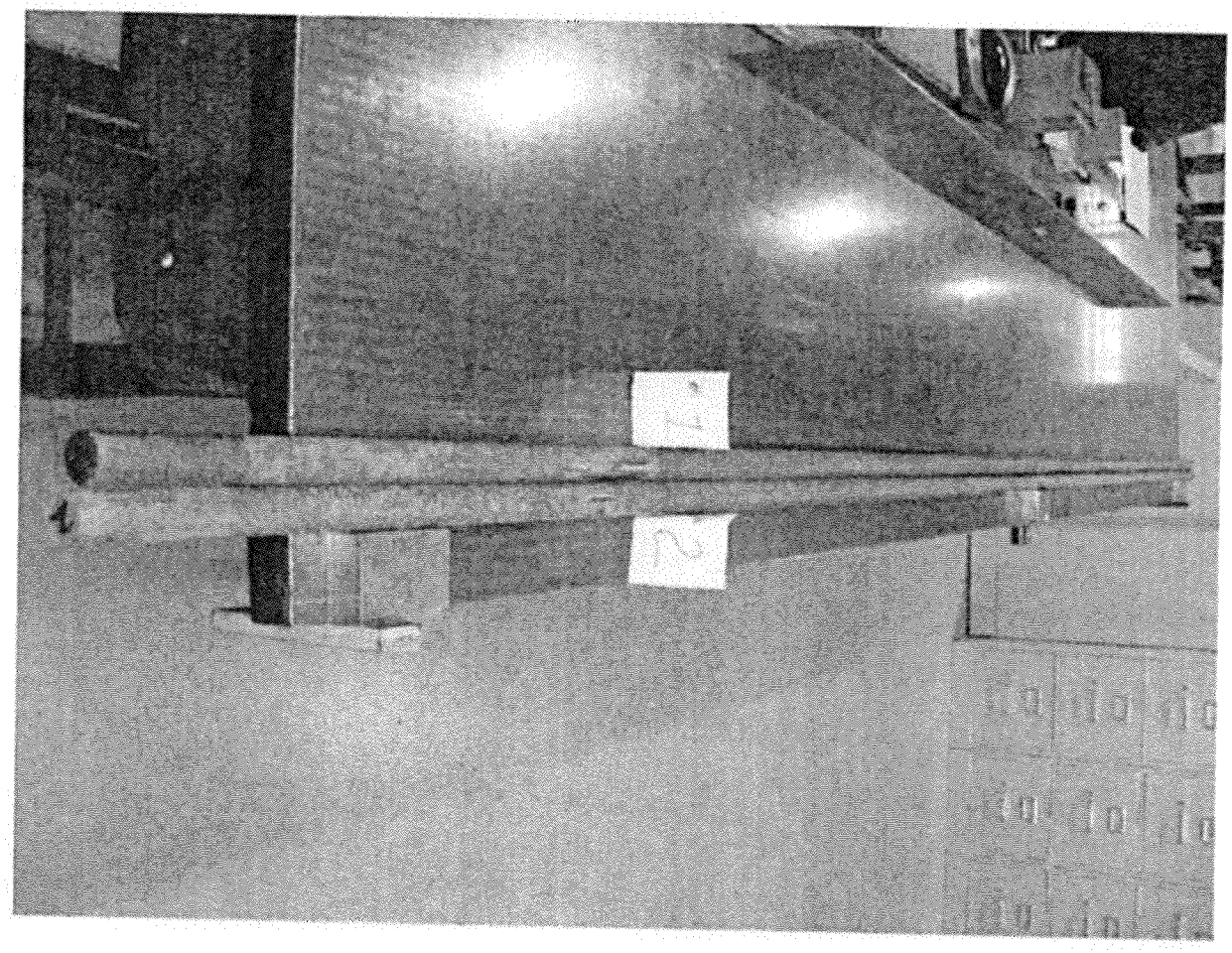
FIG. 7 is a photograph of solution treated and aged bars of Ti-10V-2Fe-3Al alloy after hot stretch straightening according to a non-limiting embodiment of this disclosure.

The hot stretch straightened bars (Serial #1 and Serial #2) are shown in the photograph of FIG. 7. The bars had a maximum deviation from straight of 0.094 inch (2.387 mm) over any 5 foot (1.524 m) length. Serial #1 bar was lengthened by 1.313 inch (3.335 cm), and Serial #2 bar was lengthened by 2.063 inch (5.240 cm) during hot stretch straightening.

EXAMPLE 4

The chemistries of bars Serial #1 and Serial #2 after hot stretch straightening according to Example 3 were compared with the chemistry of the 1.875 inch (47.625 mm) bars of Example 2. The bars of Example 3 were produced from the same heat as the straightened bars Serial #1 and Serial #2. The results of the chemical analysis are presented in Table 1.

TABLE 1

| MOT | Size | Al | C | Fe | H | N | O | Ti | V |
|---|---|---|---|---|---|---|---|---|---|
| 69550C | 1.875"RD | 3.089 | 0.008 | 1.917 | 0.004 | 0.006 | 0.108 | 85.275 | 9.654 |
| 69550C | 1.875"RD | 3.070 | 0.007 | 1.905 | 0.005 | 0.004 | 0.104 | 85.346 | 9.616 |
| 69550C | 1.875"RD | 3.090 | 0.010 | 1.912 | 0.004 | 0.004 | 0.102 | 85.288 | 9.647 |
| 69550C | 1.875"RD | 3.088 | 0.009 | 1.926 | 0.005 | 0.004 | 0.106 | 85.291 | 9.635 |
| 69550C | 1.875"RD | 3.058 | 0.007 | 1.913 | 0.006 | 0.004 | 0.104 | 85.350 | 9.610 |
| | AVG | 3.079 | 0.008 | 1.915 | 0.005 | 0.004 | 0.105 | 85.310 | 9.632 |
| 92993F | 1"RD | 3.098 | 0.006 | 1.902 | 0.005 | 0.002 | 0.112 | 85.306 | 9.608 |
| 92993F | 1"RD | 3.060 | 0.006 | 1.899 | 0.004 | 0.002 | 0.104 | 85.368 | 9.598 |
| | AVG | 3.079 | 0.006 | 1.901 | 0.004 | 0.002 | 0.108 | 85.337 | 9.603 |

No change in chemistry was observed to have occurred from hot stretch straightening according to the non-limiting embodiment of Example 3.

EXAMPLE 5

The mechanical properties of the hot stretch straightened bars Serial #1 and Serial #2 were compared with control bars that were solution treated and aged, 2-plane straightened at 1400° F., and bumped. Bumping is a process in which a small amount of force is exerted with a die on a bar to work out small amounts of curvature over long lengths of the bar. The control bars consisted of Ti-10V-2Fe-3Al alloy and were 1.772 inch (4.501 cm) in diameter. The control bars were $\alpha+\beta$ solution treated at 1460° F. (793.3° C.) for 2 hours and water quenched. The control bars were aged at 950° F. (510° C.) for 8 hours and air quenched. The tensile properties and fracture toughness of the control bars and the hot stretch straightened bars were measured, and the results are presented in Table 2.

TABLE 2

| MOT | DIASIZE (inch) | HEAT | YLD (ksi) | UTS (ksi) | ELG (%) | RA (%) | $K1_C$ (ksi $in^{1/2}$) |
|---|---|---|---|---|---|---|---|
| Hot Straightened and Bumped Bars | | | | | | | |
| 69548E | 1.772RD | H94H | 170.13 | 183.04 | 12.14 | 42.91 | 44.10 |
| 69548E | 1.772RD | H94H | 172.01 | 183.99 | 11.43 | 41.59 | 45.90 |
| 69548E | 1.772RD | H94H | 173.09 | 183.48 | 10.71 | 41.76 | 48.90 |
| 69548E | 1.772RD | H94H | 171.53 | 182.76 | 12.14 | 46.96 | 47.30 |
| 69548E | 1.772RD | H94H | 170.48 | 182.97 | 11.43 | 38.53 | 46.60 |
| 69548E | 1.772RD | H94H | 169.51 | 183.84 | 11.43 | 40.20 | 46.60 |
| 69548E | 1.772RD | H94H | 171.38 | 183.02 | 12.86 | 47.69 | 46.00 |
| 69548E | 1.772RD | H94H | 171.21 | 183.31 | 12.14 | 44.40 | 47.90 |
| | | AVG | 171.17 | 183.30 | 11.79 | 43.00 | 46.66 |
| Hot Stretch Straightened Bars | | | | | | | |
| 92993F | 1RD | H94H | 172.01 | 182.68 | 8.57 | 29.34 | 47.50 |
| 92993F | 1RD | H94H | 170.78 | 180.91 | 10.00 | 36.85 | 49.40 |
| | | AVG | 171.39 | 181.79 | 9.29 | 33.10 | 48.45 |
| Target Mean | | | 167 | 176 | 6 | NA | 39 |
| Minimums | | | 158 | 170 | 6 | NA | 40 |

All properties of the hot stretch straightened bars meet the target and minimum requirements. The hot stretch straightened bars, Serial #1 and Serial #2, have slightly lower ductility and reduction in area (RA) values, which is most likely a result of the elongation that occurs during straightening. However, the tensile strengths after hot stretch straightening appear to be comparable to the un-straightened control bars.

EXAMPLE 6

Figure 8:
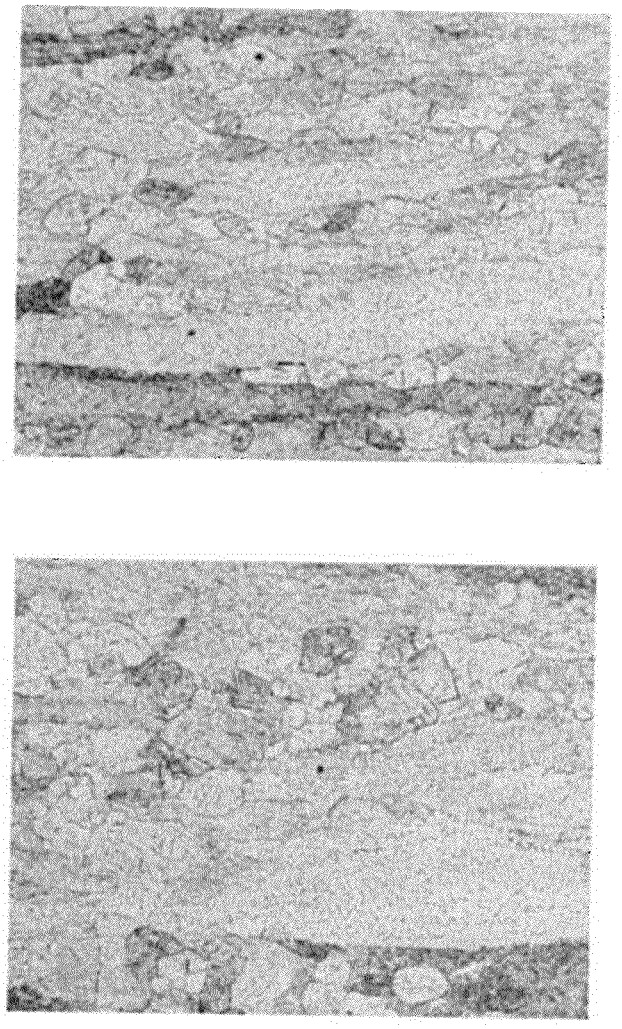
FIG. 8 includes micrographs of microstructures of the hot stretch straightened bars of non-limiting Example 7.
Figure 9:
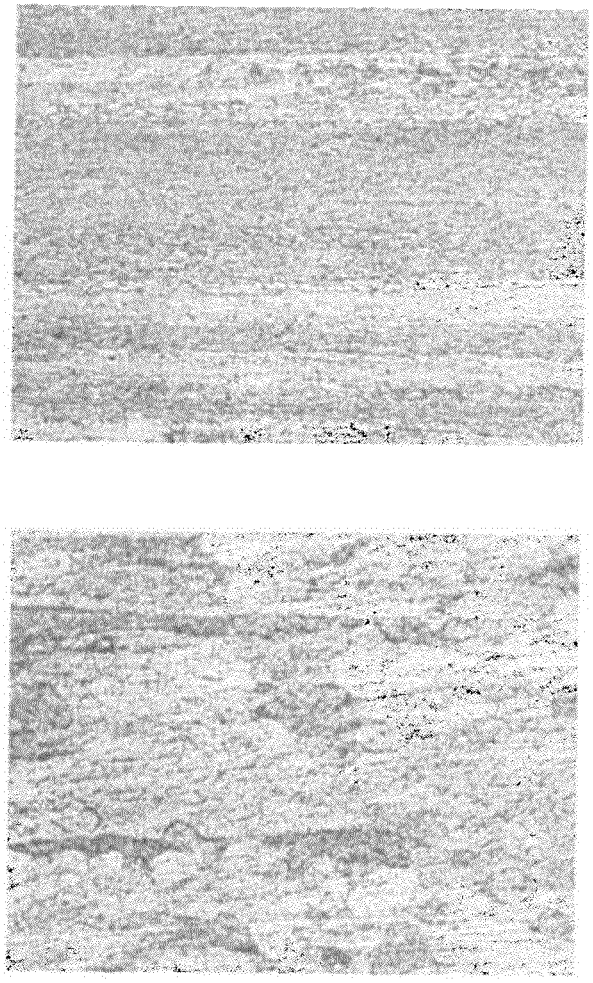
FIG. 9 includes micrographs of non-straightened solution treated and aged control bars of Example 9.

The longitudinal microstructures of the hot stretch straightened bars, Serial #1 and Serial #2, were compared with the longitudinal microstructures of the un-straightened control bars of Example 5. Micrographs of microstructures of the hot stretch straightened bars of Example 3 are presented in FIG. 8. The micrographs were taken from two different locations on the same sample. Micrographs of the microstructures of the un-straightened control bars of Example 5 are presented in FIG. 9. It is observed that the microstructures are very similar.

The present disclosure has been written with reference to various exemplary, illustrative, and non-limiting embodiments. However, it will be recognized by persons having ordinary skill in the art that various substitutions, modifications, or combinations of any of the disclosed embodiments (or portions thereof) may be made without departing from the scope of the invention as defined solely by the claims. Thus, it is contemplated and understood that the present disclosure embraces additional embodiments not expressly set forth herein. Such embodiments may be obtained, for example, by combining and/or modifying any of the disclosed steps, ingredients, constituents, components, elements, features, aspects, and the like, of the embodiments described herein. Thus, this disclosure is not limited by the description of the various exemplary, illustrative, and non-limiting embodiments, but rather solely by the claims. In this manner, it will be understood that the claims may be amended during prosecution of the present patent application to add features to the claimed invention as variously described herein.

I claim:

1. A method for straightening a solution treated and aged titanium alloy form, comprising:

heating a solution treated and aged titanium alloy form to a straightening temperature, wherein the straightening temperature comprises a straightening temperature in the α+β phase field in a straightening temperature range of 1100° F. (611.1° C.) below a beta transus temperature of the solution treated and aged titanium alloy form to 25° F. (13.9° C.) below an age hardening temperature of the solution treated and aged titanium alloy form;

applying an elongation tensile stress to the solution treated and aged titanium alloy form for a time sufficient to elongate and straighten the solution treated and aged titanium alloy form to provide a straightened solution treated and aged titanium alloy form, wherein the straightened solution treated and aged titanium alloy form deviates from straight by no greater than 0.125 inch (3.175 mm) over any 5 foot length (152.4 cm) or shorter length; and cooling the straightened solution treated and aged titanium alloy form while simultaneously applying a cooling tensile stress to the straightened solution treated and aged titanium alloy form;

wherein the cooling tensile stress is sufficient to balance a thermal cooling stress in the straightened solution treated and aged titanium alloy form and maintain a deviation from straight of no greater than 0.125 inch (3.175 mm) over any 5 foot length (152.4 cm) or shorter length of the straightened solution treated and aged titanium alloy form.

2. The method of claim 1, wherein after applying an elongation tensile stress and cooling, the straightened solution treated and aged titanium alloy form deviates from straight by no greater than 0.094 inch (2.388 mm) over any 5 foot length (152.4 cm) or shorter length of the straightened solution treated and aged titanium alloy form.

3. The method of claim 1, wherein the straightened solution treated and aged titanium alloy form deviates from straight by no greater than 0.25 inch (6.35 mm) over any 10 foot (304.8 cm) length of the straightened solution treated and aged titanium alloy form.

4. The method of claim 1, wherein the straightened solution treated and aged titanium alloy form is a form selected from the group consisting of a billet, a bloom, a round bar, a square bar, an extrusion, a tube, a pipe, a slab, a sheet, and a plate.

5. The method of claim 1, wherein heating comprises heating at a heating rate from 500° F./min (277.8° C./min) to 1000° F./min (555.6° C./min).

6. The method of claim 1, wherein the age hardening temperature used to harden the solution treated and aged titanium alloy form is in a range of 500° F. (277.8° C.) below a β-transus temperature of the titanium alloy to 900° F. (500° C.) below the β-transus temperature of the titanium alloy.

7. The method of claim 1, wherein the straightening temperature is in a straightening temperature range of 200° F. (111.1° C.) below the age hardening temperature of the solution treated and aged titanium alloy form to 25° F. (13.9° C.) below the age hardening temperature of the solution treated and aged titanium alloy form.

8. The method of claim 1, wherein cooling comprises cooling to a final temperature at which the cooling tensile stress can be removed without changing the deviation from straight of the straightened solution treated and aged titanium alloy form.

9. The method of claim 1, wherein cooling comprises cooling to a final temperature no greater than 250° F. (121.1° C.).

10. The method of claim 1, wherein the titanium alloy form comprises a near α-titanium alloy.

11. The method of claim 1, where the titanium alloy form comprises an alloy selected from the group consisting of Ti-8Al-1Mo-1V alloy (UNS R54810) and Ti-6Al-2Sn-4Zr-2Mo alloy (UNS R54620).

12. The method of claim 1, wherein the titanium alloy form comprises an α+β-titanium alloy.

13. The method of claim 1, wherein the titanium alloy form comprises an alloy selected from the group consisting of Ti-6Al-4V alloy (UNS R56400), Ti-6Al-4V ELI alloy (UNS R56401), Ti-6Al-2Sn-4Zr-6Mo alloy (UNS R56260), Ti-5Al-2Sn-2Zr-4Mo-4Cr alloy (UNS R58650), and Ti-6Al-6V-2Sn alloy (UNS R56620).

14. The method of claim 1, wherein the titanium alloy form comprises a β-titanium alloy.

15. The method of claim 1, wherein the titanium alloy form comprises an alloy selected from the group consisting of Ti-10V-2Fe-3Al alloy (UNS 56410), Ti-5Al-5V-5Mo-3Cr alloy (UNS unassigned), Ti-5Al-2Sn-4Mo-2Zr-4Cr alloy (UNS R58650), and Ti-15Mo alloy (UNS R58150).

16. The method of claim 1, wherein the yield strength and ultimate tensile strength of the solution treated and aged titanium alloy form after straightening are within 5 percent of those of the solution treated and aged titanium alloy form before straightening.

* * * * *